United States Patent [19]

Brady

[11] Patent Number: 5,066,009

[45] Date of Patent: Nov. 19, 1991

[54] CUE BALL SCRATCH INDICATOR

[76] Inventor: David L. Brady, 6141 E. 31st St., Tucson, Ariz. 85711

[21] Appl. No.: 565,027

[22] Filed: Aug. 9, 1990

[51] Int. Cl.[5] ..... A63B 71/00

[52] U.S. Cl. ..... 273/14

[58] Field of Search ..... 273/2, 11, 14

[56] References Cited

U.S. PATENT DOCUMENTS 3,319,958 5/1967 Bender ..... 273/14

3,881,727 5/1975 Olson ..... 273/14

FOREIGN PATENT DOCUMENTS 9547 of 1912 United Kingdom ..... 273/14

*Primary Examiner*—Theatrice Brown

[57] ABSTRACT

A device to aid in the game of eight ball pool. It consists of a base flange having three concave indentations labeled (SOLIDS), (STRIPES), and (CHOICE) and able to hold a cue ball in any one of them. This unit is secured to the top rail of a pool table. When a player scratches (pockets) the cue ball, a player may then retrieve the cue ball from the cue ball return and place it in the proper station of the invention (SOLIDS), (STRIPES), or (CHOICE). This placement indicates to the next shooter that a scratch has taken place and which balls to play next whether or not the scratch was observed, therefore the game may continue without further player communications or delays.

1 Claim, 1 Drawing Sheet

CUE BALL SCRATCH INDICATOR

BACKGROUND OF THE INVENTION

At the present time in the game of eight ball pool the method of communications between players when the cue ball scratched was for the next shooter to observe the instant scratch shot or be instructed verbally by the opponent as to the scratch and which balls were to be played next, (solids-stripes-or choice). This method can be very time consuming and difficult especially in a loud and busy location such as a tavern. To overcome these shortcommings of existing methods, the present invention is developed to provide a simple and effective means of player communications when one player scratches the cue ball and it is the next shooters turn to take over the table.

SUMMARY OF THE INVENTION

The object of the cue ball scratch indicator is to provide visible and discriptive placement of a scratched cue ball to improve player communications in the game of eight ball pool. This function shortens the average game time by preventing unnecessary delays, and in general the game will proceed more smoothly with less misunderstandings.

DETAILED DESCRIPTION OF THE INVENTION

Figure 1:
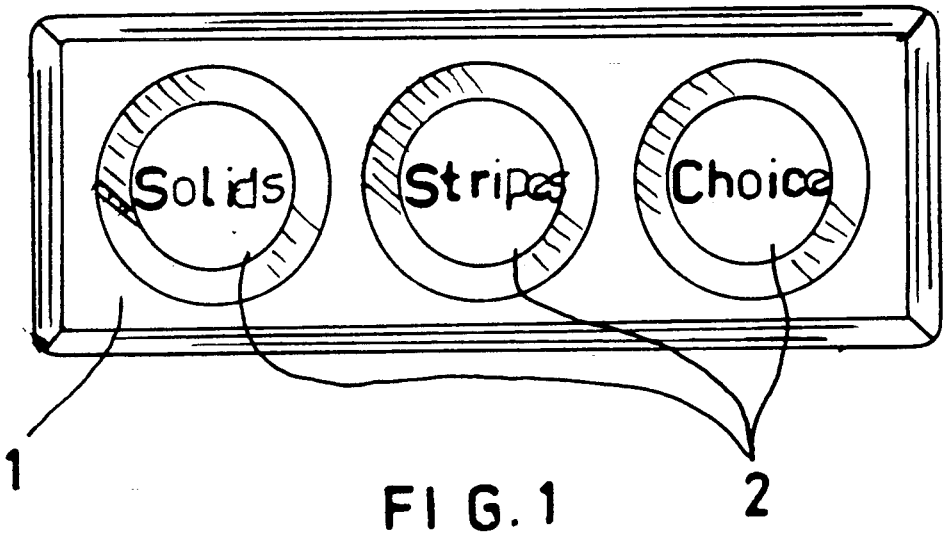
FIG. 1—Top view

Referring to the drawing in FIG. 1, #1 designates the base flange. This flange can be made of any suitable material such as plastic or metal. #2 designates the three concave indentations, labeled solids, stripes, and choice.

Figure 2:
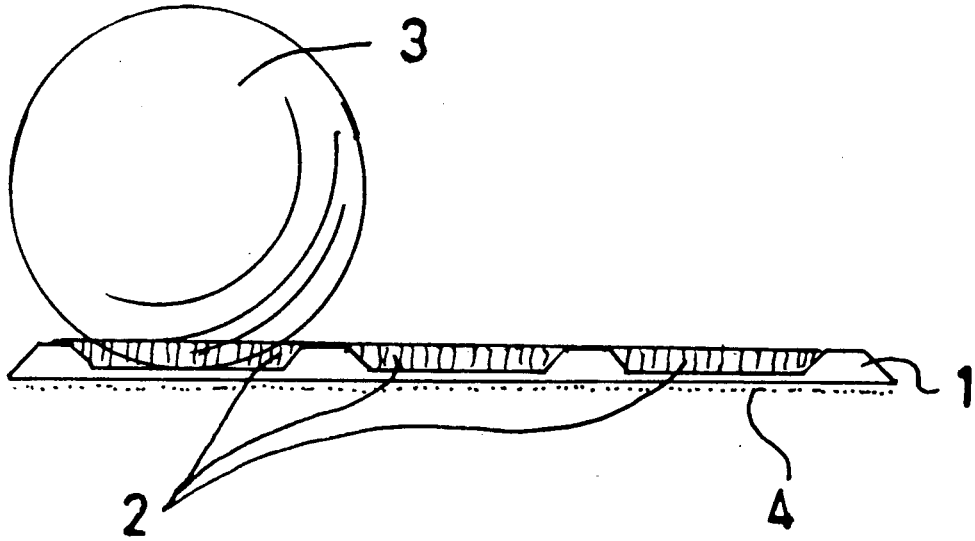
FIG. 2—Cross sectional view

Referring to the drawing in FIG. 2, #1 designates the base flange, having #2 three concave indentations each adapted to sustain a cue ball #3. #4 indicates adhesive used to secure flange to top rail of a pool table.

I claim:

1. A cue ball scratch indicator apparatus for use on a Pool table wherein said indicator is comprised of a substantially rectangular base member, said base member having a planer lower surface and an upper surface, said upper surface having three inditations therein for retaining a cue ball placed therein, means on said lower surface for attaching said indicator to the upper surface of a pool table, a first of said inditations being labeled "solids", a second of said inditations being labeled "stripes", and a third of said inditations being labeled "choice".

* * * * *